US008137533B2

(12) United States Patent
Towler et al.

(10) Patent No.: US 8,137,533 B2
(45) Date of Patent: Mar. 20, 2012

(54) MIXTURE OF CATALYSTS FOR CRACKING NAPHTHA TO OLEFINS

(75) Inventors: Gavin P. Towler, Inverness, IL (US); Hayim Abrevaya, Kenilworth, IL (US)

(73) Assignee: UOP LLC, Des Plaines, IL (US)

( * ) Notice: Subject to any disclaimer, the term of this patent is extended or adjusted under 35 U.S.C. 154(b) by 420 days.

(21) Appl. No.: 12/257,929

(22) Filed: Oct. 24, 2008

(65) Prior Publication Data

US 2010/0105974 A1 Apr. 29, 2010

(51) Int. Cl.
*C10G 11/05* (2006.01)

(52) U.S. Cl. ..... 208/120.01; 585/649; 585/650; 585/651; 585/653

(58) Field of Classification Search ..... None
See application file for complete search history.

(56) References Cited

U.S. PATENT DOCUMENTS

| | | | | |
|---|---|---|---|---|
| 5,026,935 | A | 6/1991 | Leyshon et al. | 585/315 |
| 5,026,936 | A | 6/1991 | Leyshon et al. | 585/315 |
| 5,043,522 | A | 8/1991 | Leyshon et al. | 585/651 |
| 6,258,257 | B1 | 7/2001 | Swan, III et al. | 208/74 |
| 6,288,298 | B1 | 9/2001 | Rodriguez et al. | 585/648 |
| 6,300,537 | B1 | 10/2001 | Strohmaier et al. | 585/653 |
| 6,521,563 | B2 | 2/2003 | Strohmaier et al. | 502/214 |
| 6,791,002 | B1 | 9/2004 | Abrevaya et al. | 585/648 |
| 6,867,341 | B1 | 3/2005 | Abrevaya et al. | 585/650 |
| 2006/0011514 | A1 * | 1/2006 | van den Berge et al. | 208/120.01 |

FOREIGN PATENT DOCUMENTS

| | | | |
|---|---|---|---|
| EP | 109060 | B1 | 3/1987 |
| EP | 109059 | B1 | 7/1987 |

OTHER PUBLICATIONS

Kaiser, V. and Picciotti, M.; "Better Ethylene Separation Unit" Hydrocarbon Processing Magazine, Nov. 1988, pp. 57-61.

* cited by examiner

*Primary Examiner* — Tam M Nguyen
(74) *Attorney, Agent, or Firm* — Arthur E Gooding

(57) ABSTRACT

A process is presented for the selective catalytic cracking of naphtha to light olefins. The process includes contacting a naphtha feedstream with a mixture of catalysts to reduce the amount of recycle, and especially the recycle of light paraffins. The mixture of catalysts includes a first molecular sieve made up from a small pore zeolite having a pore index between 13 and 26, and a second molecular sieve made up from an intermediate pore zeolite having a pore index between 26 and 30.

20 Claims, 6 Drawing Sheets

MIXTURE OF CATALYSTS FOR CRACKING NAPHTHA TO OLEFINS

FIELD OF THE INVENTION

The present invention relates to a process for the production of light olefins from a naphtha feed stream. This invention also relates to using improved zeolite mixtures in the process for producing light olefins.

BACKGROUND OF THE INVENTION

Ethylene and propylene, light olefin hydrocarbons with two or three atoms per molecule, respectively, are important chemicals for use in the production of other useful materials, such as polyethylene and polypropylene. Polyethylene and polypropylene are two of the most common plastics found in use today and have a wide variety of uses both as a material for fabrication and as a material for packaging. Other uses for ethylene and propylene include the production of vinyl chloride, ethylene oxide, ethylbenzene and alcohol. Steam cracking or pyrolysis of hydrocarbons produces most of the ethylene and some propylene. One of the disadvantages of steam cracking is the low ratio of propylene to ethylene. Hydrocarbons used as feedstock for light olefin production include natural gas, petroleum liquids, and carbonaceous materials including coal, recycled plastics or any organic material.

An ethylene plant is a very complex combination of reaction and gas recovery systems. The feedstock is charged to a cracking zone in the presence of steam at effective thermal conditions to produce a pyrolysis reactor effluent gas mixture. The pyrolysis reactor effluent gas mixture is stabilized and separated into purified components through a sequence of cryogenic and conventional fractionation steps. A typical ethylene separation section of an ethylene plant containing both cryogenic and conventional fractionation steps to recover an ethylene product with a purity exceeding 99.5% ethylene is described in an article by V. Kaiser and M. Picciotti, entitled, "Better Ethylene Separation Unit." The article appeared in HYDROCARBON PROCESSING MAGAZINE, November 1988, pages 57-61 and is hereby incorporated by reference.

Methods are known for increasing the conversion of portions of the products of the the ethylene production from a zeolitic cracking process to produce more propylene by a disproportionation or metathesis of olefins. Such processes are disclosed in U.S. Pat. No. 5,026,935 and U.S. Pat. No. 5,026,936 wherein a metathesis reaction step is employed in combination with a catalytic cracking step to produce more propylene by the metathesis of $C_2$ and $C_4$ olefins obtained from cracking. The catalytic cracking step employs a zeolitic catalyst to convert a hydrocarbon stream having 4 or more carbon atoms per molecule to produce olefins having fewer carbon atoms per molecule. The hydrocarbon feedstream to the zeolitic catalyst typically contains a mixture of 40 to 100 wt-% paraffins having 4 or more carbon atoms per molecule and 0 to 60 wt-% olefins having 4 or more carbon atoms per molecule. In U.S. Pat. No. 5,043,522, it is disclosed that the preferred catalyst for such a zeolitic cracking process is an acid zeolite, examples includes several of the ZSM-type zeolites or the borosilicates. Of the ZSM-type zeolites, ZSM-5 was preferred. It was disclosed that other zeolites containing materials which could be used in the cracking process to produce ethylene and propylene included zeolite A, zeolite X, zeolite Y, zeolite ZK-5, zeolite ZK-4, synthetic mordenite, dealuminized mordenite, as well as naturally occurring zeolites including chabazite, faujasite, mordenite, and the like. Zeolites which were ion-exchanged to replace alkali metal present in the zeolite were preferred. Preferred alkali exchange cations were hydrogen, ammonium, rare earth metals and mixtures thereof.

European Patent No. 109,059B1 discloses a process for the conversion of a feedstream containing olefins having 4 to 12 carbon atoms per molecule into propylene by contacting the feedstream with a ZSM-5 or a ZSM-11 zeolite having a silica to alumina atomic ratio less than or equal to 300 at a temperature from 400 to 600° C. The ZSM-5 or ZSM-11 zeolite is exchanged with a hydrogen or an ammonium cation. The reference also discloses that, although the conversion to propylene is enhanced by the recycle of any olefins with less than 4 carbon atoms per molecule, paraffins which do not react tend to build up in the recycle stream. The reference provides an additional oligomerization step wherein the olefins having 4 carbon atoms are oligomerized to facilitate the removal of paraffins such as butane and particularly isobutane which are difficult to separate from $C_4$ olefins by conventional fractionation. In a related European Patent No. 109,060B1, a process is disclosed for the conversion of butenes to propylene. The process comprises contacting butenes with a zeolitic compound selected from the group consisting of silicalites, boralites, chromosilicates and those chromosilicates and those zeolites ZSM-5 and ZSM-11 in which the mole ratio of silica to alumina is greater than or equal to 350. The conversion is carried out at a temperature from 500° C. to 600° C. and at a space velocity of from 5 to 200 kg/hr of butenes per kg of pure zeolitic compound. The European Patent No. 109,060B1 discloses the use of silicalite-1 in an ion-exchanged, impregnated, or co-precipitated form with a modifying element selected from the group consisting of chromium, magnesium, calcium, strontium and barium.

U.S. Pat. No. 6,867,341 to Abrevaya et al. teaches naphtha cracking using a catalyst comprising a molecular sieve having 10-membered rings with channels of length 0.1 to 0.3 micrometers and having a silicon to aluminum atomic ratio of about 20 to about 200. In particular, examples are presented showing that a high Si/Al2 ratio Ferrierite catalyst is more effective for naphtha conversion and gives higher yields of the desired products ethylene and propylene than other zeolites examined. Preferred operating temperatures in the range 650 to 670 C are indicated, and operating pressures should be as low as can be economically achieved.

U.S. Pat. No. 6,288,298 to Rodriguez et al. teaches cracking of a naphtha stream that contains a mixture of paraffins and olefins (for example, a product stream from a steam naphtha cracker or a FCC process) using a high silicon content SAPO-11 catalyst with AEL structure. Preferred operating temperatures in the range 500° C. to 600° C. are indicated. The SAPO catalyst is shown by example to have higher activity and selectivity for propylene than conventional FCC catalyst additives such as ZSM-5. U.S. Pat. No. 6,300,537 and U.S. Pat. No. 6,521,563, both to Strohmaier et al. (and both assigned to ExxonMobil) show similar results using a different preparation of high silicon SAPO-11 designated ECR-42.

U.S. Pat. No. 6,258,257 to Swan et al. teaches a two stage process for producing C2 to C4 olefins from gas oil in which the gas oil is first contacted with an FCC catalyst to produce an olefinic naphtha stream and this naphtha stream is then contacted with ZSM-5 or other small or medium pore zeolites at a temperature in the range 630° C. to 650° C.

U.S. Pat. No. 6,791,002 to Abrevaya et al. teaches use of a plurality of riser reactors attached to a common regenerator, allowing each riser reactor to contact an oil stream at different conditions of temperature and residence time. Unconverted intermediate products from catalytic cracking of naphtha are recycled to different riser reactors where they are contacted with catalyst under the appropriate reaction conditions.

All of the above prior art schemes suffer from the disadvantage that multiple reaction reaction steps are needed to effectively convert the feed into the desired products. This increases the complexity and cost of the reaction system, as well as increasing the amount of material that must be collected in the separation system for recycle to the reactors. The overall effect is to increase the capital and operating costs of the catalytic naphtha cracking process.

It is difficult in naphtha cracking to obtain high selectivity to ethylene and propylene, while maintaining high conversion. Improvements in catalysts and processes that accomplish this are therefore desirable.

SUMMARY OF THE INVENTION

The invention is a naphtha-cracking catalyst formulation or a means of loading catalyst that seeks to maximize the selective yield of desired products per reactor pass and hence reduce the amount of light material that must be recycled, while also reducing reactor complexity. The novel process is for the selective catalytic cracking of naphtha to light olefins, using a combination of catalysts to increase the first pass through conversion and reduce the amount of recycle of light paraffins. The process comprises contacting a naphtha feedstream with a combination of catalysts at reaction conditions. The catalyst combination includes a first molecular sieve comprising a small pore zeolite having a pore index between 13 and 26, and a second molecular sieve comprising an intermediate pore zeolite having a pore index between 26 and 30. The catalyst combination comprises the first molecular sieve in an amount between 5 and 95 wt % of the catalyst, and the second molecular sieve comprises an amount between 5 and 95 wt % of the catalyst.

In a preferred embodiment, for the maximization of propylene production, the catalyst mixture comprises the first molecular sieve in an amount between 10 and 50 wt % of the catalyst and the second molecular sieve in an amount between 50 and 90 wt % of the catalyst.

Additional objects, embodiments and details of this invention can be obtained from the following drawings and detailed description of the invention.

DETAILED DESCRIPTION OF THE INVENTION

Figure 1:
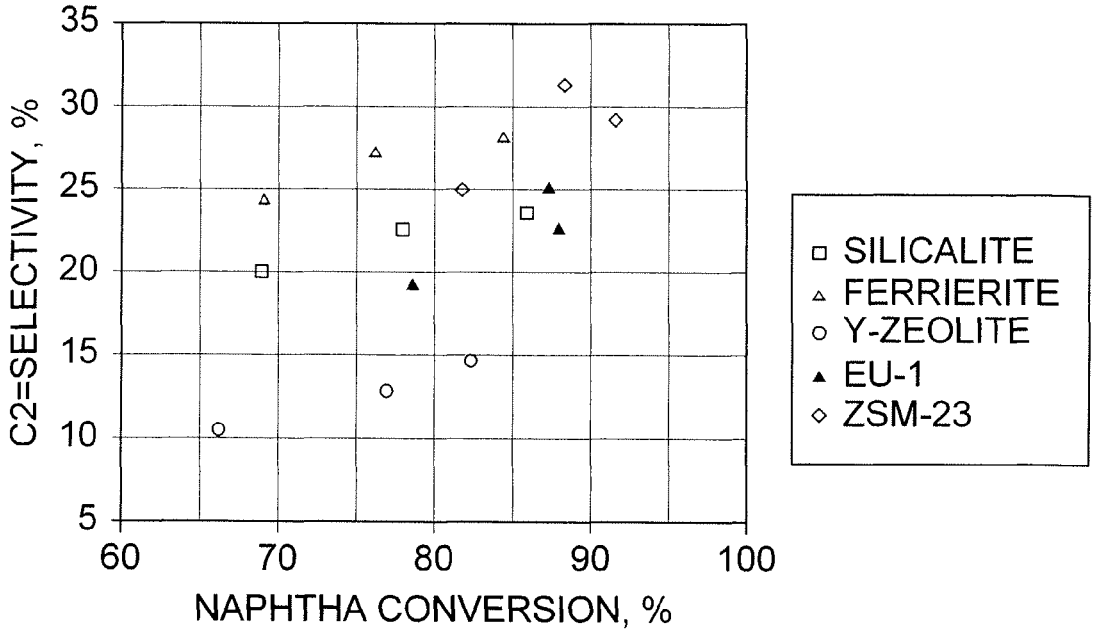
FIG. 1 shows the effect of conversion (by space time) on ethylene (C2=) selectivity.

Catalytic naphtha cracking has started to develop as a new route for the production of light olefins. There are several advantages of using a catalytic process over the conventional steam cracking, including improved yields and reduced material costs as a result of lower reactor temperatures.

A drawback of catalytic naphtha cracking is that it is difficult to accomplish full conversion of the feed in a single reactor pass. The optimum catalyst and process conditions for naphtha conversion are not optimal for conversion of intermediate products such as C4 and and C5 olefins and paraffins, propane, ethane, etc.

If large amounts of these byproducts form then they must be separated from the desired products (chiefly ethylene and propylene) the separation and recycle of these byproducts can impose high costs on the process. This is particularly true for light byproducts, as the separation of these compounds is usually carried out by cryogenic distillation. In general, it is substantially cheaper to recycle naphtha or gasoline range material that can be distilled without cryogenic techniques than it is to recycle low-boiling compounds such as ethane, propane and butanes.

The present invention provides for selective catalytic naphtha cracking. The naphtha is cracked to light olefins using a combination of catalysts. The use of a mixture of catalysts reduces the byproducts and thereby reduces the amount of material that needs to be recycled for further cracking. A naphtha feedstream is contacted with a mixture of catalysts at reaction conditions to control the relative production of ethylene and propylene. The mixture comprises at least two catalysts wherein a first molecular sieve comprising a small pore zeolite having a pore index between 13 and 26, and a second molecular sieve comprising an intermediate pore zeolite having a pore index between 26 and 30. The first molecular sieve comprises between 5 and 95 wt % of the catalyst, and the second molecular sieve comprises between 5 and 95 wt % of the catalyst. The pore index (PI) is the product of the two principal dimensions, or diameters, of the pore and is in units of square Angstroms ($Å^2$). The pore dimensions are typically expressed in Angstroms (Å).

In one embodiment, preferably, the first molecular sieve comprises a zeolite having a small pore, 10 membered ring (MR) where the pore index is between 22 and 26. In this embodiment, the first molecular sieve comprises between 90 and 95 wt % of the catalyst. In addition, the molecular sieve has a silica-alumina ($SiO_2/Al_2O_3$) ratio between 20 and 600, with a preferred silica-alumina ratio between 200 and 400. The first molecular sieve further comprises a crystal size between 0.1 and 0.3 micrometers.

Catalytic naphtha cracking comprises contacting a naphtha feedstream, in gaseous form, with a catalyst mixture as described above. For example, the contacting of the naphtha with the catalyst can be carried out in a fluidized catalytic cracking (FCC)-type reactor. The process then entails feeding the hot catalyst and the vaporized, preheated naphtha into a reactor vessel, where the catalyst mixes with the gas and is entrained with the gas, and produces a gas-produces a gas-catalyst mixture that reacts under operating conditions to produce a product gas and a used catalyst. The choice of reactor can be any fluidized-type of reactor for intimately mixing the naphtha feedstream with the catalyst. Reactors of this type are well known to those skilled in the art. A fluidized reactor usable in this invention is described in U.S. Pat. No. 6,183,699, which is incorporated by reference in its entirety. The product gas and used catalyst exit the reactor where the catalyst and gas are separated. The separation process of gas and catalyst is well known to those skilled in the art. Following the separation of ethylene, propylene and aromatics, the unconverted naphtha, plus ethane, propane, butane and butanes can be recycled back to the reactor to make more ethylene and propylene.

The reaction conditions for naphtha cracking with the new catalyst include operating the reactor at a temperature between 550° C. to about 700° C. A preferred temperature for operating the process is to be in the range from about 600° C. to about 675° C. with a more preferred operating temperature of about 625° C. to about 670° C. The reaction process further includes hydrocarbon partial pressures between 17 kPa (2.5 psia) and 690 kPa (100 psia). Preferred partial pressures are between 100 kPa (15 psia) and 690 kPa (100 psia). The weight hourly space velocities WHSV for the process is between 2 $hr^{-1}$ and 200 $hr^{-1}$, and preferably from about 10 $hr^{-1}$ to about 100 $hr^{-1}$. As is understood in the art, the weight hourly space velocity is the weight flow of the feed divided by the catalyst weight.

For maximizing ethylene yield, the catalyst comprises a molecular sieve mixture wherein the second molecular sieve is a nano-silicalite with a silica-alumina ration greater than 200. The second molecular sieve comprises between 90 and 95 wt % of the catalyst, with the first molecular sieve comprising the remainder.

In a preferred embodiment of the catalyst for maximizing ethylene yield, the silica-alumina ratio of the nano-silicalite is between 600 and 1600.

The demand for propylene has increased faster than the demand for ethylene, and increasing the production of propylene from naphtha cracking is desirable. For maximizing propylene production, the catalyst mixture comprises a first molecular sieve making up between 10 and 50 wt % of the catalyst, and the second molecular sieve comprises between 50 and 90 wt % of the catalyst. The first molecular sieve comprises a small pore zeolite having a pore index between 13 and 26, with a silica-alumina ratio between 20 and 600. Preferably, the silica-alumina ratio is between 200 and 400.

Suitable materials for the first molecular sieve include zeolites selected from rho (PI=13), chabazite (PI=14.4), ZK-5 (PI=15.2), ITQ-3 (PI=16.3), ZK-4 (PI=16.8), erionite (PI=18.4), ferrierite (PI=22.7), clinoptilolite (PI=23.3) and ZSM-22 (PI=26.2). Mixtures of suitable zeolites are also useable as the first molecular sieve. These zeolite additives are also suitable for converting C3/C2 to light olefins.

The second molecular sieve for maximizing propylene production comprises an intermediate pore zeolite having a pore index between 26 and 30. One zeolite preferably comprises nano-silicalite with a silica-alumina ratio greater than 200. A more preferred form of the nano-silicalite for the second molecular sieve is one with a silica-alumina ratio between 600 and 1600.

According to this invention a mixture of catalyst should be used in catalytic naphtha cracking. The catalysts should be selected with the following objectives in mind. The reaction conditions for the results shown in FIGS. 1-6 include a temperature of 650 C, a pressure between 122 kPa and 129 kPa (3-4 psig), with the highest conversion at an $N_2$:HCBN molar ratio of 2.7 and a reaction time of 2 sec, the intermediate conversion at an $N_2$:HCBN molar ratio of 0.7 and a reaction time of 1.4 sec, and the lowest conversion at an $N_2$:HCBN molar ratio of 0.7 and a reaction time of 1.2 sec.

High ethylene selectivity from the cracking of naphtha is favored over small non-intersecting 10-membered-ring zeolites with a pore index in the range of 22 to 26. This is particularly true when the crystal size along the channel dimensions is on the order of 0.1 to 0.3 micrometers, and the silica-alumina ratio is in the range of 20 to 600. FIG. 1 shows ethylene selectivity to be much higher with small 10-MR Si/Al2=70 Ferrierite (PI=22.7) and Si/Al2=89 ZSM-23 (PI=23.4) than larger 10-MR Si/Al2=570 Silicalite (PI=29.7) and 12-MR Si/Al2=81 Y-zeolite (PI=54.8). Si/Al2=70 EU-1 (PI=22.1) gives unexpectedly low ethylene selectivity due to the presence of side pockets that make the apparent pore size larger.

Figure 2:
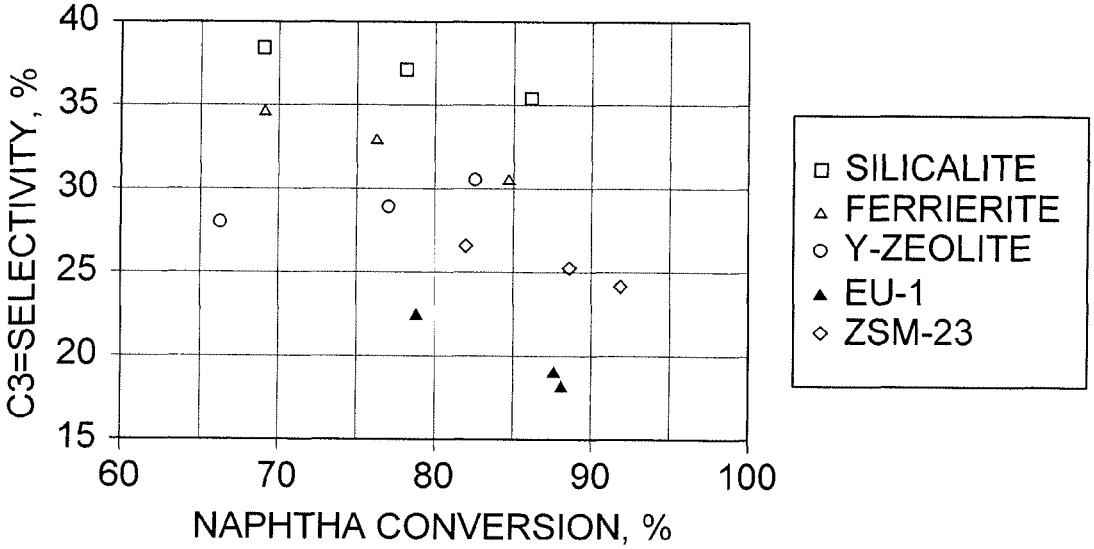
FIG. 2 shows the effect of conversion (by space time) on propylene (C3=) selectivity.

High propylene selectivity from cracking of naphtha is favored over larger 10-membered-ring zeolites having a pore index between 26 and 30. However, in order to suppress large transition state-high reaction order undesirable hydrogen transfer and aromatization reactions, the acid sites need to be quite far apart and the crystal size needs to be small. For example, when the silica-alumina ratio should be greater than 200. The presence of intersecting 10-membered-ring channels, such as with Silicalite, or the presence of 12- of 12-membered-ring channels should not hurt the selectivity. FIG. 2 shows the highest propylene selectivity to be obtained over nano-silicalite having a silica-alumina ratio of 570. Nano-silicalite has crystal sizes in the 0.1 micrometer range or smaller. The silica-alumina ratio in Y-zeolite displayed here is not high enough to compensate for the adverse effect of large 12-membered-ring channels, hence the propylene selectivity is not very high.

Figure 3:
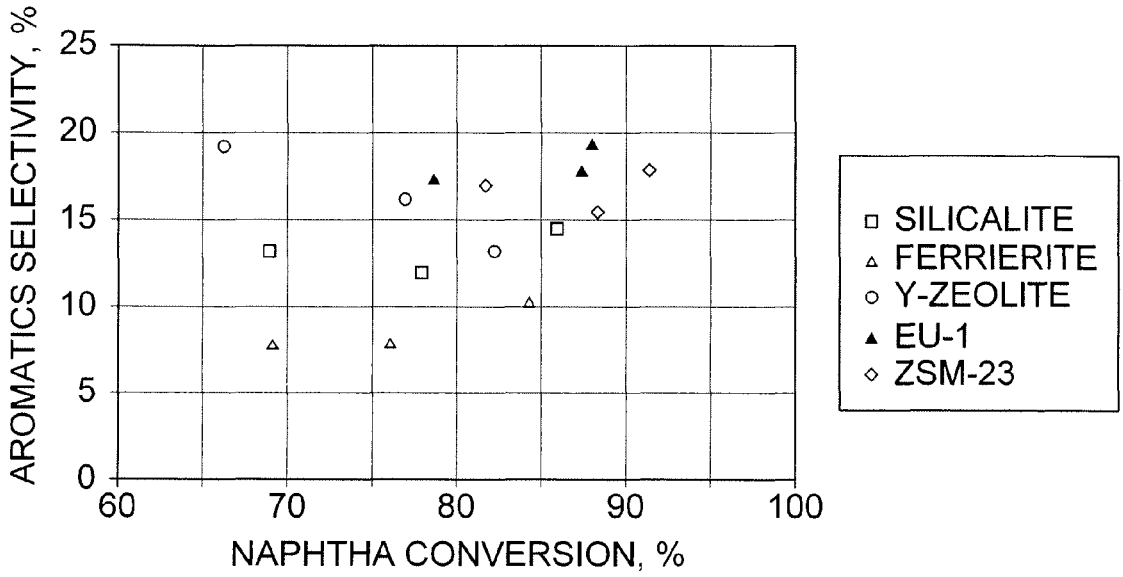
FIG. 3 shows effect of conversion (by space time) on aromatics selectivity.

The results presented in FIG. 3 demonstrate that high aromatics selectivity over Y-zeolite prevents the propylene selectivity from reaching its highest potential.

Figure 4:
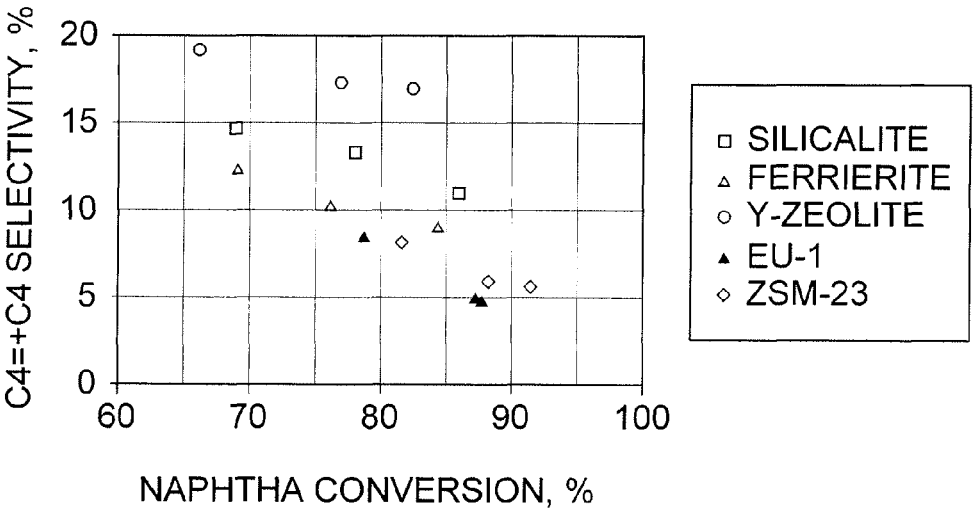
FIG. 4 shows effect of conversion (by space time) on C4= and C4 selectivity.

Low butene and butane (C4= and C4) selectivity from cracking of naphtha is favored over small non-intersecting 10-membered-ring zeolites and large 8-membered-ring zeolites with pore index in the range 16-26. The results summarized in FIG. 4 illustrate that a correlation exists between pore index and C4= and C4 selectivity. While these results only display the performance of 10-membered-ring and 12-membered-ring zeolites, lower C4= and C4 selectivity is expected with large 8-membered-ring zeolites.

Figure 5:
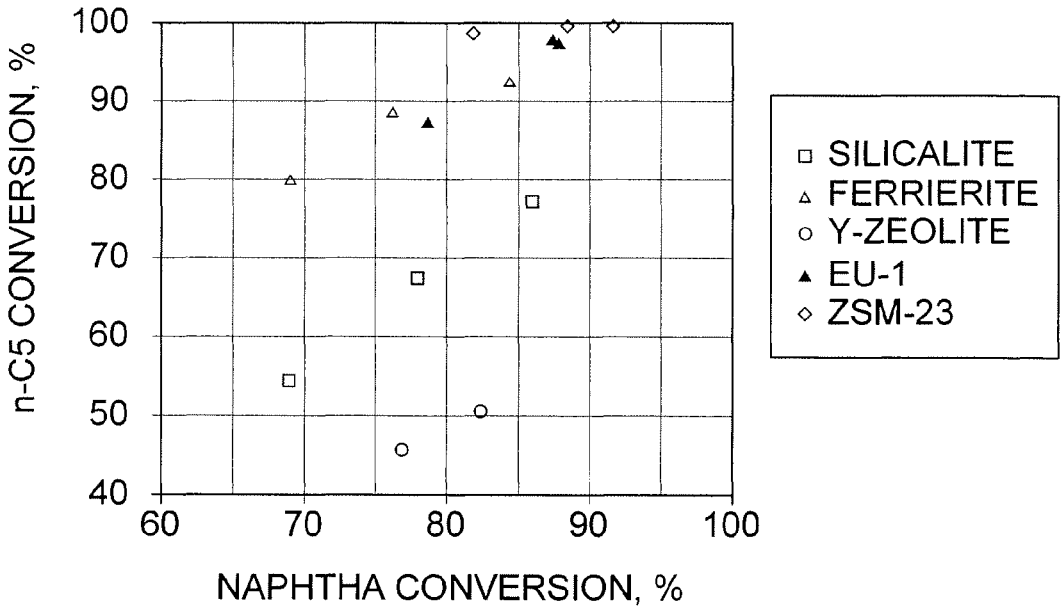
FIG. 5 shows relation between n-C5 and naphtha conversions (by space time)

Butene and butane selectivity increases with increasingly larger pore indexes. In these examples the selectivity is mostly normal butenes and butanes, n-C4= and n-C4, rather than isobutenes and isobutanes, i-C4= and i-C4. While not being constrained to any theory, it is believed that this is caused by the inability of large pore zeolites to perform secondary cracking on small hydrocarbon molecules. This is consistent with the inability of large pore zeolites to perform primary cracking on small hydrocarbon molecules as well. For example, the results in FIG. 5 illustrate that it is difficult to convert n-pentane in a naphtha feed when the pore index is large. N-pentane is another hydrocarbon with a small kinetic diameter like butene and butane. The trends are progressively reversed when the kinetic diameter of the hydrocarbon becomes larger and approaches the dimensions of the pore channel.

Figure 6:
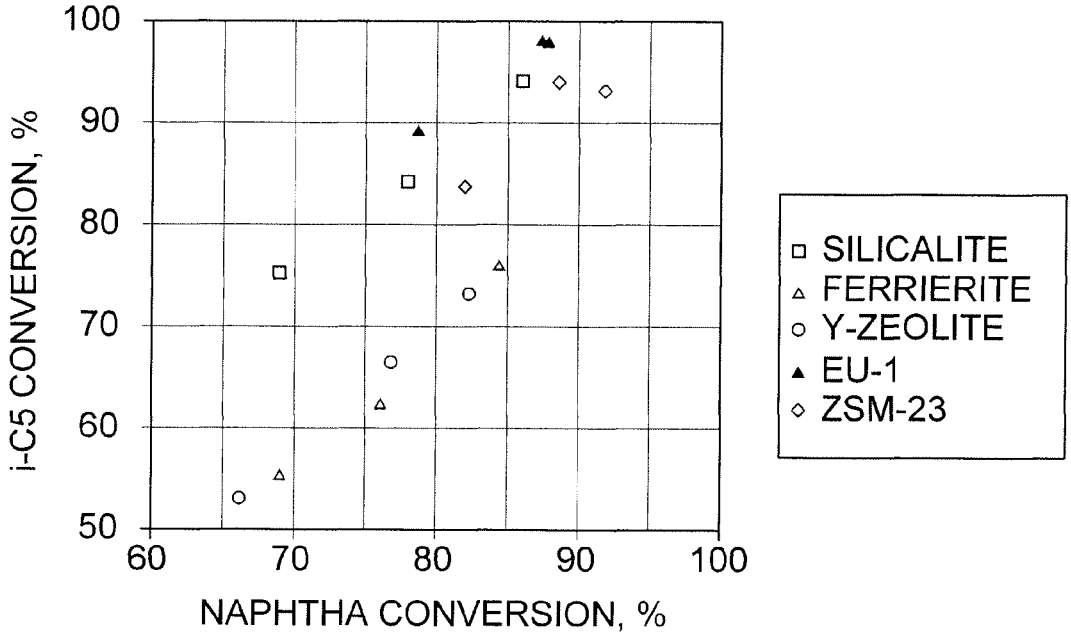
FIG. 6 shows relation between i-C5 and naphtha conversions (by space time)

Further results illustrated in FIG. 6 show that isopentane in a naphtha feed has an easier time converting over the larger pore index nano-silicalite than over the smaller pore index ferrierite. The isopentane is about 15 wt % of the feed for these examples. The low isopentane reactivity over Y-zeolite can be explained by the fact that while the isopentane is larger than the normal pentane, the isopentane is still small with respect to the dimensions of the 12-membered-ring channels.

The selection of zeolites should also factor in the potential for coke formation. Low coke formation increases the life between regeneration cycles. Low coke selectivity from cracking of naphtha is favored over large 10-membered-ring zeolites, having a pore index between 26 and 30, and with a silica-alumina ratio greater than 200. The crystal size should be in the range from 0.1 to 0.3 micrometers. For example, under the same test conditions used for all zeolites illustrated here, the coke selectivity is low, about 0.2%, only for nano-silicalite and relatively high, between 3 and 8%, for all other zeolites that are either small 10 or 12-membered-ring zeolites.

Figure 7:
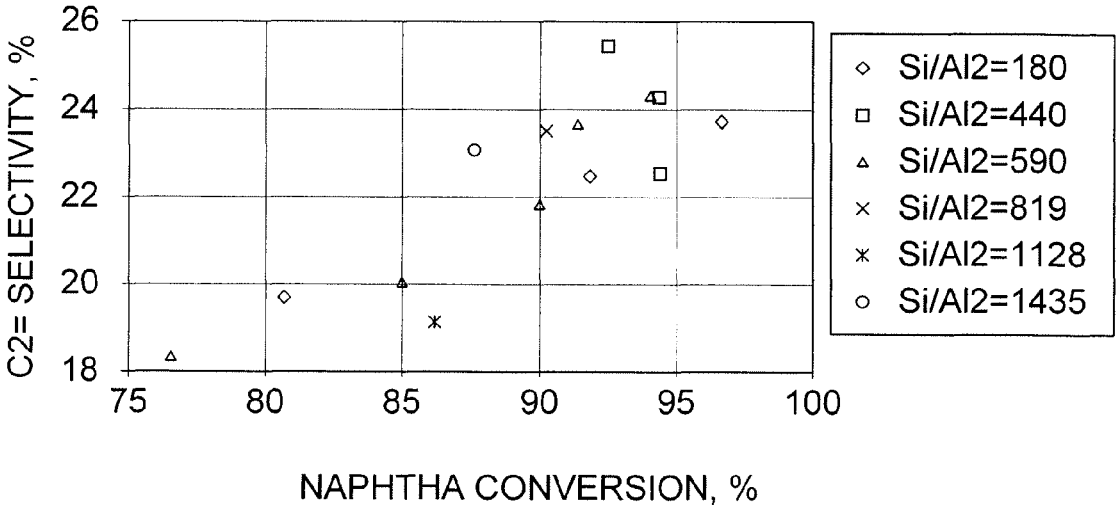
FIG. 7 shows effect of conversion (by amount of catalyst) and Si/Al2 on C2= selectivity over nano-silicalite.
Figure 8:
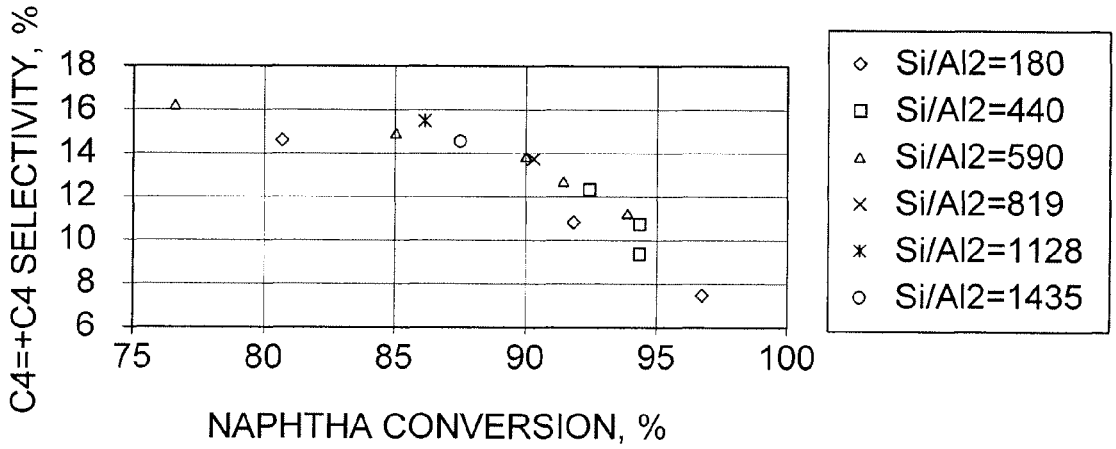
FIG. 8 shows effect of conversion (by amount of catalyst) and Si/Al2 on C4= and C4 selectivity over nano-silicalite.

Over a broad range of silica-alumina ratios for the cracking of naphtha to light olefins, high ethylene selectivity is favored at high conversions. Several nano-silicalite catalysts with different silica-alumina ratios were tested using different loadings of catalysts, hence different zeolite:hydrocarbon (HCBN) wt. ratios. The results, summarized in FIG. 7, illustrate increasingly higher ethylene selectivity at increasing conversion. This increased ethylene selectivity at high conversion is primarily due to secondary cracking of butenes and butanes, which is favored at high conversion. This is also illustrated by the results shown in FIG. 8 with the same nano-silicalite series discussed here. The zeolite:HCBN weight ratios should be at least 15, with a preferred weight ratio at least 30. The weight ratio can in the range from 15 to 150.

Figure 9:
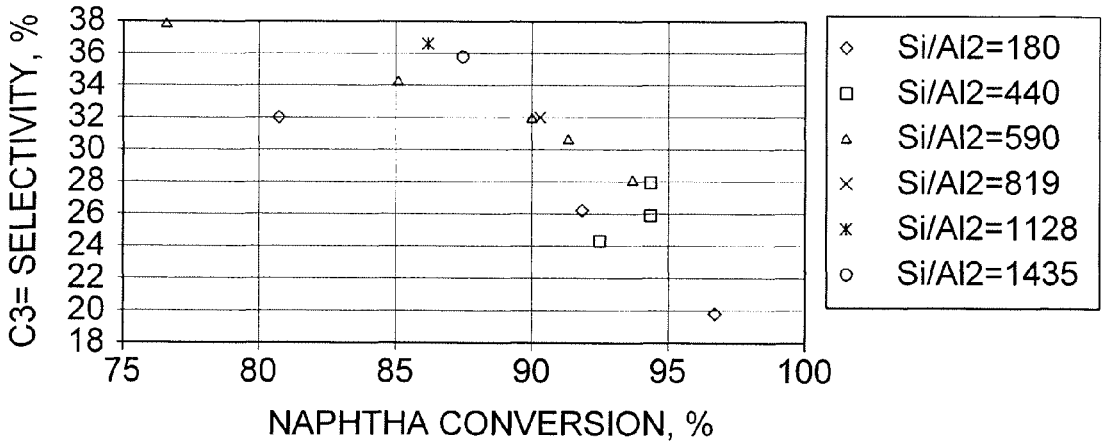
FIG. 9 shows effect of conversion (by amount of catalyst) and Si/Al2 on C3= selectivity over nano-silicalite.
Figure 10:
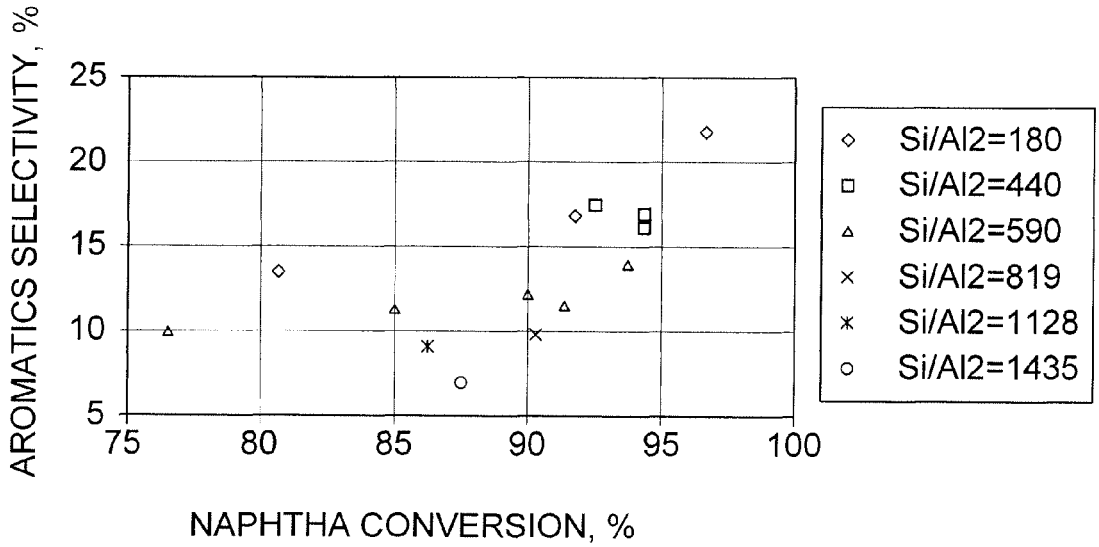
FIG. 10 shows effect of conversion (by amount of catalyst) and Si/Al2 on aromatics selectivity over nano-silicalite.
Figure 11:
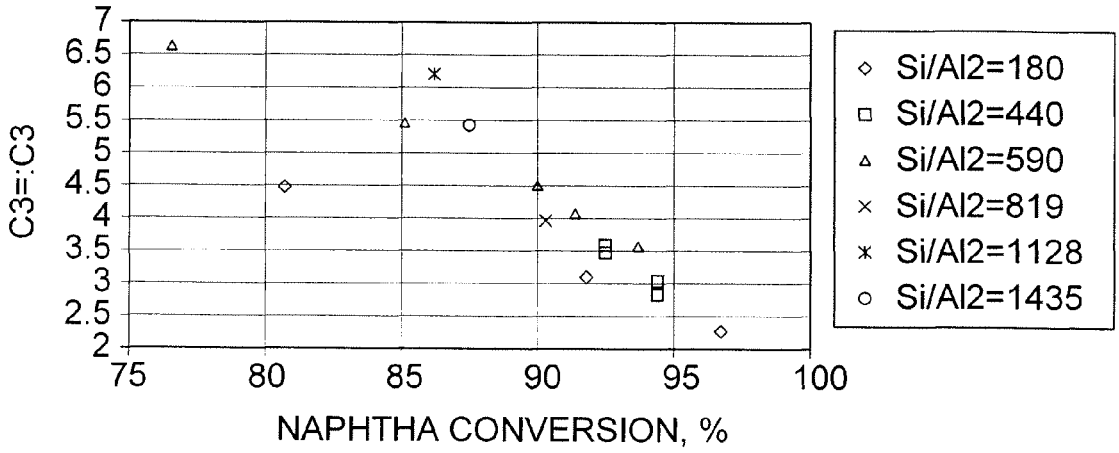
FIG. 11 shows effect of conversion (by amount of catalyst) and Si/Al2 on C3=:C3 ratio over nano-silicalite.

However, propylene selectivity is favored at lower conversion, which is the opposite effect from ethylene selectivity. This is illustrated with the same nano-silicate catalysts used, as shown in FIGS. 9 to 11. The trends from the data indicate that propylene selectivity reaches a maximum in the conversion range from 60% to 70%. Propylene selectivity is adversely impacted by high conversion which also favors high aromatics formation, as illustrated in FIG. 10. And, another adverse influence on propylene selectivity at high conversion is hydrogen transfer reactions. This is demonstrated by the increasing propane:propylene ratio with higher conversion, as seen in FIG. 11.

Figure 12:
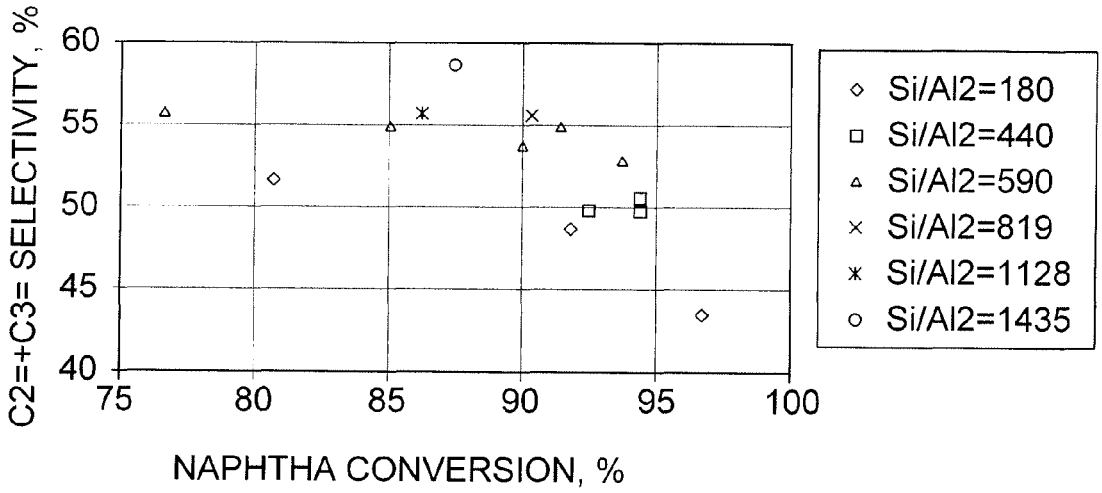
FIG. 12 shows effect of conversion (by amount of catalyst) and Si/Al2 on C2= and C3= selectivity over nano-silicalite.

While the selectivities of propylene and ethylene are oppositely impacted by high conversion, when the conversion level is below about 90%, the sum of propylene and ethylene selectivities is relatively insensitive to the conversion level, as illustrated by the data in FIG. 12. This indicates a trade off from propylene to ethylene as conversion increases.

The selection of catalyst and operating conditions is dependent on the choice of increased selectivity of either propylene or ethylene.

When operating for maximizing propylene yields, the catalytic cracking is operated at a conversion level of about 60-70%. Here, the adverse effect of relatively low conversion on high butene and butane selectivity is addressed by having a small pore size zeolite additive at a level between 10% and 50% level in the catalyst formulation along with a nano-silicalite in the range between 50% and 90%. The nano-silicalite should have a silica-alumina ratio greater than 200, and preferably the ratio should be in the range from 600 to 1600. The beneficial effect of the additive in lowering per pass butene and butane selectivity is illustrated by the following examples in Table 1 below. The test conditions were 650° C., 170 kPa (10 psig) total pressure, zeolite:HCBN=40, and no diluent.

TABLE 1

Conversion of naphtha to light olefins

| Catalyst | Nano-Silicalite | Nano-Silicalite | 50% Nano-Silicalite (front-end) + 50% Ferrierite (back-end) | Ferrierite |
|---|---|---|---|---|
| Si/Al2 | 1128 | 1128 | | 126 |
| Conversion, % | 86 | 86 | 91 | 90 |
| Selectivities, % | | | | |
| C1 | 3.6 | 3.2 | 4.4 | 6.6 |
| C2 | 5.2 | 5.3 | 5.5 | 6.8 |
| C2= | 19.0 | 21.0 | 22.3 | 22.2 |
| C3 | 5.9 | 6.3 | 6.9 | 7.0 |
| C3= | 36.5 | 36.6 | 28.4 | 24.1 |
| C4=/C4 | 15.6 | 15.6 | 11.3 | 9.8 |
| C10+ | 4.1 | 4.6 | 3.4 | 3.1 |
| Aromatics | 9.2 | 6.6 | 11.6 | 14.3 |
| coke | 0.2 | 0.2 | 5.4 | 4.8 |
| H2 | 0.8 | 0.6 | 0.9 | 1.2 |

Ideally, all of these reactions should be carried out in the same reactor under the same process conditions. Suitable process conditions include temperatures in the range 600 to 700 C, and low hydrocarbon partial pressures in the range 5 to 50 psig. Lower hydrocarbon partial pressures can be achieved by dilution of the feed with steam.

When operating to maximize ethylene yields, the catalytic cracking is operated to achieve a conversion level around 90%. The reactor will utilize a catalyst such as nano-silicalite with a silica-alumina ratio greater than 200, and preferably in the range of 600 to 1600. An alternative is to use a small pore 10-membered-ring zeolite with a silica-alumina ratio in the range from 20 to 600. The preferred silica-alumina ratio is between 200 and 400, and the crystal size is preferred to be in the 0.1 to 0.3 micrometer range.

Alternatively, if the rate of coking can be controlled to a low enough level, the reactions can be carried out inside tubes placed in a furnace, in which case the catalysts can be loaded in sequence such that the feed contacts first the nano-silicalite and then the small-pore zeolite. If the rate of coke formation is low then the catalyst can be regenerated periodically by burning with air or with a depleted air stream to allow for good temperature control.

The advantage of using a mixture of catalysts for this process is that the selectivity per reactor pass can be substantially increased. The effect of this is to reduce the amount of material that must be sent through the separation section per ton of product, and hence reduce the (large) separation section capital and operating costs. It is particularly advantageous if the amount of low molecular weight paraffin material (C2 to C4) can be reduced, as it is more expensive to process this material as recycle streams than it is to process recycle streams of naphtha range material.

While it is advantageous to achieve high conversion of low molecular weight paraffin material in a single pass to be able to reduce the amount of recycle, the lighter ethane and propane portion of this fraction is expected to be less reactive and may require more severe operating conditions. In that case, injecting these lighter recycle streams to the catalyst coming from the regenerator (or heat exchanger) at the highest temperature location would be preferred, i.e., 675-690° C.

While the invention has been described with what are presently considered the preferred embodiments, it is to be understood that the invention is not limited to the disclosed embodiments, but it is intended to cover various modifications and equivalent arrangements included within the scope of the appended claims.

The invention claimed is:

1. A process for selective catalytic cracking of naphtha to light olefins comprising contacting a naphtha feedstock stream with a combination of catalysts at reaction conditions to control the relative production of ethylene and propylene, the catalyst combination comprising a first molecular sieve catalyst comprising a small pore zeolite having a pore index between 13 and 26, and a second molecular sieve catalyst comprising an intermediate pore zeolite having a pore index between 26 and 30, wherein the first molecular sieve catalyst comprises between 5 and 95 wt % of the catalyst, and the second molecular sieve catalyst comprises the remainder of the catalyst combination, wherein the combination of catalysts is a physical mixture of different catalyst particles.

2. The process of claim 1 for maximizing ethylene production wherein the first molecular sieve catalyst comprises a small pore, 10 membered ring molecular sieve comprising between 90 and 95 wt % of the catalyst combination, and where the pore index is between 22 and 26.

3. The process of claim 2 wherein the first molecular sieve catalyst has a silica-alumina ratio between 20 and 600.

4. The process of claim 3 wherein the first molecular sieve catalyst has a silica-alumina ratio between 200 and 400.

5. The process of claim 2 wherein the first molecular sieve catalyst comprises a crystal size between 0.1 and 0.3 micrometers.

6. The process of claim 1 for maximizing ethylene production wherein the second molecular sieve catalyst comprises a nano-silicalite with silica-alumina (Si/Al2) ratio greater than 200, and wherein the nano-silicalite comprises between 90 and 95 wt % of the catalyst combination.

7. The process of claim 6 wherein the nano-silicalite has a silica-alumina ratio between 600 and 1600.

8. The process of claim 1 wherein the reaction conditions include temperatures in the range from about 550° C. to about 700° C.

9. The process of claim 1 wherein the reaction conditions include partial pressures of the hydrocarbons in the range from about 17 kPa (2.5 psia) to about 690 kPa (100 psia).

10. The process of claim 1 wherein the reaction conditions include weight hourly space velocities from about 2 $hr^{-1}$ to about 200 $hr^{-1}$.

11. The process of claim 1 for maximizing propylene production wherein the first molecular sieve catalyst comprises between 10 and 50 wt % of the catalyst combination and the second molecular sieve catalyst comprises between 50 and 90 wt % of the catalyst combination.

12. The process of claim 11 wherein the first molecular sieve catalyst comprises a small pore zeolite having a pore index between 13 and 26 and a silica-alumina ratio between 20 and 600.

13. The process of claim 12 wherein the first molecular sieve catalyst has a silica-alumina ratio between 200 and 400.

14. The process of claim 12 wherein in the first molecular sieve catalyst is a zeolite selected from the group consisting of rho, chabazite, ZK-5, ITQ-3, ZK-4, erionite, ferrierite, clinoptilolite, ZSM-22, and mixtures thereof.

15. The process of claim 11 wherein the second molecular sieve catalyst comprises nano-silicalite with a silica-alumina ratio greater than 200.

16. The process of claim 15 wherein the nano-silicalite has a silica-alumina ratio between 600 and 1600.

17. A process for selective catalytic cracking of naphtha to light olefins having a high propylene fraction comprising contacting a naphtha feedstock stream with a combination of catalysts at reaction conditions to control the relative production of ethylene and propylene, the catalyst combination comprising a first molecular sieve catalyst comprising a small pore zeolite having a pore index between 13 and 26, and a second molecular sieve catalyst comprising an intermediate pore zeolite having a pore index between 26 and 30, wherein the first molecular sieve catalyst comprises between 10 and 50 wt % of the catalyst, and the second molecular sieve comprises between 50 and 90 wt % of the catalyst combination, wherein the combination of catalysts is a physical mixture of at least two catalysts.

18. The process of claim 17 wherein in the first molecular sieve catalyst is a zeolite selected from the group consisting of rho, chabazite, ZK-5, ITQ-3, ZK-4, erionite, ferrierite, clinoptilolite, ZSM-22, and mixtures thereof.

19. The process of claim 17 wherein the second molecular sieve catalyst comprises nano-silicalite with a silica-alumina ratio greater than 600.

20. The process of claim 17 wherein the reaction conditions include temperatures in the range from about 550° C. to about 700° C., partial pressures of the hydrocarbons in the range from about 17 kPa (2.5 psia) to about 690 kPa (100 psia), and weight hourly space velocities from about 2 $hr^{-1}$ to about 200 $hr^{-1}$.

* * * * *